United States Patent [19]

Leicht

[11] 4,195,277

[45] Mar. 25, 1980

[54] MOVING PERMANENT MAGNET LIMITED MOTION ACTUATOR

[75] Inventor: John R. Leicht, Bedford, Tex.

[73] Assignee: Xerox Corporation, Stamford, Conn.

[21] Appl. No.: 918,987

[22] Filed: Jun. 26, 1978

[51] Int. Cl.[2] ..... H01F 7/08

[52] U.S. Cl. ..... 335/229; 335/268

[58] Field of Search ..... 335/229, 230, 234, 236, 335/237, 256, 268

[56] References Cited

U.S. PATENT DOCUMENTS

| | | | |
|---|---|---|---|
| 3,379,214 | 4/1968 | Weinberg | 335/234 X |
| 3,914,723 | 10/1975 | Goodbar | 335/234 X |
| 3,928,988 | 12/1975 | Luth | 335/234 X |
| 3,952,853 | 4/1976 | Feldman | 335/234 X |

*Primary Examiner*—George Harris

[57] ABSTRACT

A limited motion actuator which utilizes a moving permanent magnet as an armature. The drive is provided by the simultaneous repulsion and attraction of the movable permanent magnet within stationary coils. The magnetic circuit is formed to allow one pole of the armature to be simultaneously repelled from the coil of like polarity and attracted to the pole of opposite polarity. The preferred magnetic circuit configuration consists of two poles and a magnetic return path, which forms two additional poles. The movable permanent magnetic armature is always located within the regions of the coil poles thus allowing accurate control of the driving forces in both forward and reverse directions over the complete armature cycle.

5 Claims, 5 Drawing Figures

MOVING PERMANENT MAGNET LIMITED MOTION ACTUATOR

BRIEF SUMMARY OF THE INVENTION

Limited motion actuators, such as solenoids or clapper magnets, are well known to the art. One use of such devices is in print hammer actuators used in high-speed printing machines, such as computer printers and word-processing machines. Currently most print hammers consist of a moving mass propelled by an external actuator to a free flight, which approximates a constant velocity condition until impact. Several basic problems exist with this type of hammer. First, where the hammer must travel a finite distance and provide low impact energy, the cycle time must be relatively long. Second, control of the impact energy is poor due to the loose control of the hammer during free flight and due to large variations in force over the actuator stroke. In the past, the solution to these problems required an expensive, heavy hammer design.

It is accordingly an object of this invention to provide a new and novel electromagnetic actuator mechanism having improved features.

Another object of this invention is to provide a limited motion actuator mechanism, which is relatively inexpensive and lightweight.

It is another object of this invention to provide a limited motion electromagnetic actuator having improved cycling characteristics, accuracy and high reliability.

The foregoing objects and other advantages will become apparent from the following description of preferred embodiments although there is no intent to limit the invention to such embodiments. To the contrary, the aim is to cover all modifications, alternatives and equivalents falling within the spirit and scope of the invention as defined by the appended claims.

BRIEF DESCRIPTION OF THE DRAWINGS

Similar reference characters refer to similar parts in each of the several figures.

DETAILED DESCRIPTION OF THE PREFERRED EMBODIMENTS

Figure 1:
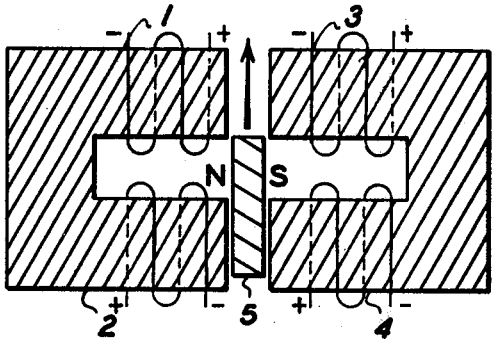
FIGS. 1–4 are diagrammatic representations shown in schematic form of side elevations of magnetic actuator mechanisms in accordance with this invention.

FIG. 1 of the drawings shows schematically an electromagnetically operated limited motion actuator in accordance with the present invention. In this figure, numbers 1, 2, 3 and 4 are legs made of a magnetic material. Each of legs 1, 2, 3 and 4 is wound with coils not shown through which an electric current can be passed making legs 1, 2, 3 and 4 electromagnetic poles. Poles 1, 2, 3 and 4 are placed in spaced relationship to armature 5 so that armature 5 can be subjected to the magnetic force of all four poles at one time. Armature 5 is a permanent magnet; N stands for North, S stands for South. The magnet portion of armature 5 is designed to be always located within the region of the coil poles 1, 2, 3 and 4 to maximize control of the accelerating and decelerating forces. To move armature 5 in the direction shown by the arrow, magnetic poles 1 and 4 are made South, and 2 and 3 are made North. It can be seen that coil pole 1 being South will attract armature 5 whereas coil pole 4 being South will repel armature 5. In the same manner, coil pole 3 being North will attract the armature whereas coil pole 2 being North will repel the armature. The force acting on armature 5 is the sum of all four pole forces as long as armature 5 is within the region of magnetic force of the four poles. By reversing the current through the four coils, 1 and 4 are made North and 2 and 3 are made South. It can be seen that pole 1 being North will repel the permanent magnet armature and that 4 being North will attract the armature. Similarly, 3 now being South will repel the armature, and 2 being South will attract the armature. It can be seen that when armature 5 is being accelerated in the direction shown by the arrow that by reversing the current, a controlled deceleration can be provided. By controlling the current direction and strength, the armature can be accelerated, decelerated and reversed, all under control.

Figure 2:
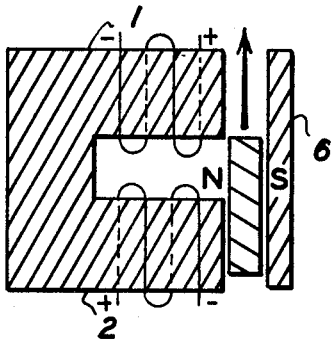

FIG. 2 is the preferred embodiment where high magnetic strength and low weight or small size are desired. Instead of using coil poles 3 and 4, they are replaced by magnetic material 6, which acts as a magnetic flux return path. The advantages which result from the use of return path 6 in place of coil poles is a weight saving and economy both in cost and in space. Further, the use of return path 6 almost doubles the force obtained from the use of coils 1 and 2 alone. For these reasons, the FIG. 2 embodiment is preferred.

Figure 3:
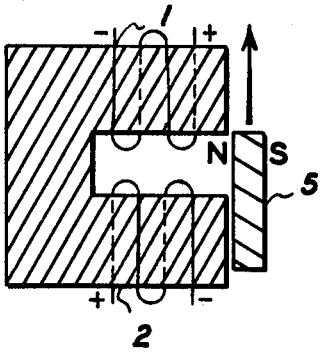

FIG. 3 is an alternative embodiment identical to that of FIG. 1 but with coil poles 3 and 4 omitted. This embodiment provides less efficient operation than that of FIGS. 1 or 2 but might be preferred for a specific utilization.

Figure 4:
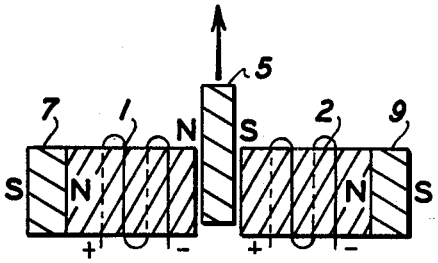

FIG. 4 represents a configuration, which reduces the mechanical response time of the actuator. When no current is applied to the electromagnet, an attractive force is present between the permanent magnet and the poles of the electromagnet. This may or may not be a desirable feature. When current is applied to the coils, a finite amount of time is required for the magnetic forces to increase to a point where they overcome the natural attractive forces of the permanent magnet to the pole of the electromagnet. This startup time may be reduced by reducing the attractive force between the permanent magnet and the poles of the electromagnet when no current is applied. This may be accomplished by inserting permanent magnets 7 and 9 in the electromagnet poles in such a manner so as to repel the permanent magnet attached to the armature thus canceling some or all of the attractive force of the armature magnet to the poles. As a result, less time is required after current initiation to overcome the attractive force of the armature magnet to the poles of the electromagnet.

Figure 5:
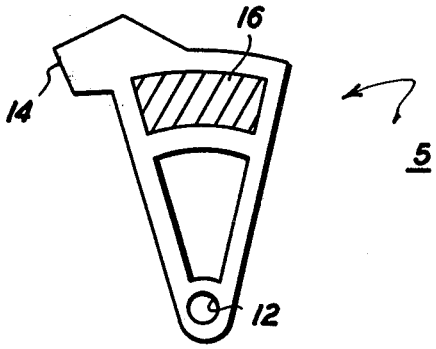
FIG. 5 is a simplified schematic view of a hammer type impact printing mechanism with which the improved limited motion electromagnetic actuator of this invention may be used.

FIG. 5 shows a typical print hammer armature for use in accordance with the subject invention. Print hammer generally referred to as 5 in the figure is an armature which is rotated about a pivot 12. Print hammer 5 further has an impact surface 14 for impacting type fonts. The print hammer here shown is similar to and can be used in the Xerox 800 Electronic Typing System. Consequently, one may, for further details of the printing mechanism, refer to that commercially available equipment and to published literature pertaining thereto. Additionally, reference may be had to commonly assigned U.S. Pat. No. 3,954,163 of Andrew Gabor, which issued on May 4, 1976, entitled "High Speed Printer With Intermittent Print Wheel and Carriage Movement". That patent is hereby incorporated by reference. Armature 5 is preferably equipped with a permanent rare earth magnetic material 16, which may be, for example, Crucore 15 from Crucible Magnetics Division. The armature is placed in one of the embodiments as shown in FIGS. 1-4. Operation of the print hammer armature is identical to that described in connection with FIG. 1, hence need not be repeated here. The advantage of using the present invention over free-flight print hammers is that the velocity can be controlled by accelerating or decelerating over the entire motion from the rest position to impact and back to the rest position; whereas in conventional free-flight type hammers, velocity can be controlled only over part of the motion and in only the forward direction.

As stated above, the preferred permanent magnet material is a rare earth magnet. This material permits a low-cost, low-inertia, high-torque, fast-responding and small-sized actuator. The rare earth material may be used in the repulsion mode cyclically without fear of demagnetization. The preferred magnetic configuration is a short magnet length, which is ideal for a moving magnet application where low inertia is required.

This invention offers an actuator, which has a relatively large uniform force or torque output in both forward and reverse directions over the entire stroke, thus allowing accurate control to be obtained, and accelerate or decelerate maneuvers to be accomplished anywhere within the stroke. High reliability is obtained since the only moving part is the armature; there are, for example, no moving leads.

What is claimed is:

1. An electromagnetic actuator mechanism comprising at least two electromagnetic poles of opposite polarity, an armature comprising a permanent magnet positioned within the field of magnetic influence of said at least two electromagnetic poles, the actuator mechanism being characterized in that said armature is adapted to move in a direction perpendicular to said magnetic field.

2. The electromagnetic actuator mechanism of claim 1, wherein there is included a magnetic flux return path.

3. The electromagnetic actuator mechanism of claim 1 wherein said armature is pivoted for rotation about the pivot axis.

4. The electromagnetic actuator mechanism of claim 3 wherein said pivoted armature includes an impact surface.

5. The electromagnetic actuator mechanism of claim 1 wherein said permanent magnet is made from a rare earth metal.

* * * * *

UNITED STATES PATENT AND TRADEMARK OFFICE

CERTIFICATE OF CORRECTION

PATENT NO. : 4,195,277

DATED : March 25, 1980

INVENTOR(S) : John R. Leicht

It is certified that error appears in the above-identified patent and that said Letters Patent are hereby corrected as shown below:

Column 1, lines 57-58, please delete "not shown".

Signed and Sealed this

*Twenty-second* Day of *July 1980*

[SEAL]

*Attest:*

SIDNEY A. DIAMOND

*Attesting Officer*

*Commissioner of Patents and Trademarks*